US005159968A

United States Patent [19]

Lawson

[11] Patent Number: 5,159,968

[45] Date of Patent: Nov. 3, 1992

[54] PLEATED DRAPERY SYSTEM

[76] Inventor: Jack M. Lawson, 346 N. Arbor View, Spring Arbor, Mich. 49283

[21] Appl. No.: 772,150

[22] Filed: Oct. 7, 1991

[51] Int. Cl.[5] ..... A47H 13/14

[52] U.S. Cl. ..... 160/348

[58] Field of Search ..... 160/348, 341, 345, 126; 16/87.2, 87.4 R, 93 D, 94 D, 95 D, 96 D

[56] References Cited

U.S. PATENT DOCUMENTS

| | | | |
|---|---|---|---|
| 3,132,686 | 5/1964 | Judovits | 160/348 |
| 3,155,150 | 11/1964 | Silvestre | 160/348 |
| 3,157,907 | 11/1964 | Stall | 16/87.4 R |
| 3,616,486 | 11/1971 | Ford et al. | 16/87.2 |
| 3,807,482 | 4/1974 | Baker | 160/348 X |
| 4,053,009 | 10/1977 | Edlin | 160/348 |

*Primary Examiner*—David M. Purol
*Attorney, Agent, or Firm*—Beaman & Beaman

[57] ABSTRACT

A drapery hanging system for "S" type pleated drapery of a sinuous folded configuation wherein the drapery is suspended from a traverse rod supporting a plurality of slidable carriers. Adjacent carriers are interconnected by a tension connector to equally space the carriers when the drapery is closed, and abutments evenly spaced on the connector adjustably attached to the carriers permit the desired spacing of the drapery folds wherein extensive variations in drapery material width can be accommodated within a given drapery extended dimension and additional carriers may be easily added. A drapery header tape utilizes a weight supporting lip whereby hangers depending from the carriers may be easily adjustably attached to the header tape at the desired location to permit support of the drapery at those locations most advantageous with respect to the drapery material width and drapery extended dimensions.

18 Claims, 2 Drawing Sheets

PLEATED DRAPERY SYSTEM

BACKGROUND OF THE INVENTION

1. Field of the Invention

The invention pertains to a pleated drapery supporting system particularly suitable for "S" type fold drapery and wherein a variety of drapery material widths may be accommodated within a given drapery closed dimension when the drapery is extended.

2. Description of the Related Art

Commonly, the width of drapery material, prior to pleating, is substantially greater than the width of the window or opening to be draped, i.e. the closed or extended dimension of the drapery. The excess drapery width is pleated, usually with pinch pleats, to provide attractive folds in the drapery material, and carriers mounted upon the horizontal traverse rod use hooks or other means to interconnect the traverse rod carriers with the pinch pleats. The spacing between adjacent pinch pleats determines the spacing between the pleats when the drapery is fully extended as the drapery material, itself, constitutes the tension member for closing the drapery. Such typical pinch pleat drapery systems require that the width of the drapery material be accurately determined for a particular closed drapery dimension, and with such pinch pleat installations it is necessary to custom size and fit the drapery material to its extended width dimension.

It is possible to reduce the "tolerances" between the width of a drapery material and its extended dimension by using an "S" pleat. Such a pleating system forms the drapery of an "S" or sinuous configuration whereby adjacent folds directly lay against each other when the drapery is retracted. However, with an "S" pleat drapery system it is necessary to directly interconnect adjacent drapery carriers as the drapery material, itself, cannot be used as the tension member for pulling the drapery closed or extended. Without separate means for interconnecting the carriers the "forward" folds or pleats will be straightened while the "rear" pleats will remain folded and uniform unfolding of the drapery material throughout its width as the drapery is extended will not occur resulting in an unattractive hanging.

It has been proposed with "S" type drapery systems to interconnect adjacent traverse rod carriers with a string or flexible tension connector so as to space the pleats as desired when the drapery is extended. However, known drapery systems of this type do not permit ready adjustment between the spacing of adjacent carriers and still require custom installation procedures. Drapery systems in accord with the above description are illustrated in U.S. Pat. No. 3,616,486 wherein a string is molded into adjacent traverse rod carriers to determine the spacing therebetween, such a molding assembly preventing spacing adjustments between adjacent carriers to be accomplished on site.

OBJECTS OF THE INVENTION

It is an object of the invention to provide a pleated drapery system having a predetermined number of drapery carriers wherein the spacing of the carriers may be easily determined and adjusted permitting a variety of drapery material widths to be accommodated within a given drapery extended dimension.

Another object of the invention is to provide a pleated drapery system for use with "S" pleat type drapery wherein the spacing between pleats may be easily regulated and adjusted, and wherein an attractive drapery hanging can be accomplished with minimal skills.

Yet another object of the invention is to provide a pleated drapery system utilizing a plurality of traverse rod carriers wherein a flexible tension connector interconnects adjacent carriers and a releasable connecting system between the tension connector and carriers permits carrier spacing to be readily adjusted, and positively retained after adjustment.

A further object of the invention is to provide a pleated drapery system for "S" type pleated drapery utilizing a header tape which permits drapery flexibility and permits carrier supported hangers to be easily attached to the header tape at the desired location without penetration of the drapery material.

An additional object of the invention is to provide a pleated drapery system for "S" type drapery wherein a header tape includes a lip for cooperation with carrier mounted hangers permitting the hangers to be accurately positioned on the header tape and locked thereto, relative longitudinal movement between the hangers and header tape being prevented by a detent system.

Another object of the invention is to provide a pleated drapery system for use with "S" type drapery pleats wherein a header tape attached to the drapery is supported by hangers having a hook portion cooperating with a lip formed on the header tape, and a detent projection and a latch defined on the hanger cooperate with the tape lip to maintain the desired relationship between the tape and carrier.

SUMMARY OF THE INVENTION

The inventive concepts are particularly suitable for use with "S" type drapery pleat systems wherein the pleats are of a sinuous configuration producing a uniform spacing between pleats throughout the drapery width regardless of whether the drapery is fully extended or fully contracted. The drapery is mounted upon carriers slidably supported upon a traverse rod having a carrier track defined therein. The carriers are connected to the drapery by hangers or pendants suspended from the carriers and attached to a header tape fixed to the drapery by a hook portion formed on the hanger which cooperates with a lip defined on the header tape.

The hangers are capable of pivoting or swiveling about a vertical axis relative to their associated carrier to accommodate the angular change that occurs during drapery movement, and as it is desired to evenly space the pleats when the drapery is fully extended adjacent carriers are interconnected by a flexible tension connector wherein the force necessary to move the drapery material during closing or extending is transferred through the tension connector, rather than the drapery material itself, and the spacing between adjacent carriers is determined by the location of the attachment of the connector to adjacent carriers.

In order to permit a wide range of drapery material widths to be accommodated within a single drapery extended dimension the spacing between adjacent carriers can be easily determined by the use of a gauge or template, and the attachment of the flexible connector to the carriers is accomplished by a pair of detents defined on the carriers which cooperate with evenly spaced teeth or recesses formed on the connector. A recess defined in the carrier selectively receives and retains the connector, and once the connector is located within the carrier recess it will be engaged by the carrier detents and locked with respect thereto determining the spacing between adjacent carriers. Thus, as the drapery is closed the connector will determine the spacing between adjacent carriers to evenly space the pleats when the drapery is extended achieving the desired uniform appearance.

To facilitate connection of the carriers to the drapery a synthetic plastic header tape is sewn to the inside surface of the drapery adjacent the drapery upper edge. The header tape includes a primary flat body having a plurality of vertically extending slots formed therein which permit the body to be readily flexed in the lateral direction of the body inner and outer sides. On its outer side the header tape body is formed with a longitudinally extending lip which is defined by an upper base portion substantially perpendicularly related to the body, and a downwardly extending flange portion spaced from and parallel to the body outer side. Slots are defined in the lip intersecting the lip upper end base portion, and these slots are in alignment with the body slots so as to permit the desired lateral tape flexibility. The lower end of the lip is free or cantilevered, and preferably, the slots formed in the lip do not intersect the lower end of the lip.

The hanger or pendant is of an elongated configuration having a central stem. A head is formed on the upper end of the stem having a spherical configuration for cooperating with a spherical recess defined in the traverse rod carrier, and this configuration permits the hanger and carrier to relatively pivot or swivel about a substantially vertical axis.

The lower portion of the hanger includes a hook configuration which receives the free edge of the header tape lip. The hanger hook portion includes a detent projection which is received within a lip flange portion slot so as to prevent relative displacement between the hanger and the tape in the longitudinal direction of the tape. Further, a latch is defined on the hanger stem adapted to snap over the tape lip base portion when the connection between the hanger and the lip is complete thereby locking the hanger and tape in the desired relationship.

In the practice of the invention the hangers do not penetrate the drapery material, but are permitted to swivel with respect to the associated drapery location as the angle therebetween changes as the drapery is traversed between opened and closed positions. The ability to readily adjust the spacing between the carriers by means of the teeth formed on the flexible connector and the detents defined on the carriers associated with the teeth minimizes the skill required to assemble a drapery system in accord with the inventive concepts, and likewise, the ability of the hangers to readily snap onto the header tape in a supporting manner, and be changed thereto, if necessary, reduces the skill requirements of the installer. The practice of the invention permits seamless drapery fabric to be used with a minimum of cutting and trimming, and a wide variety of widths of extended dimensions can be achieved from a single manufactured drapery width reducing inventory requirements and simplifying the mail ordering of drapery and the installation skills.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
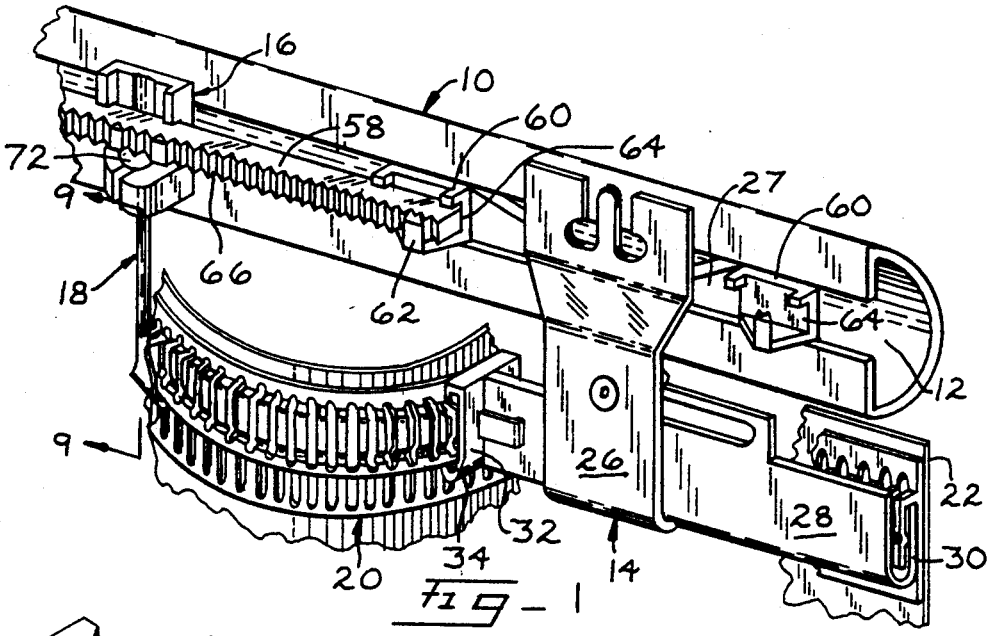
FIG. 1 is a rear perspective view of a pleated drapery system in accord with the invention illustrating the traverse rod, a master slide and a single conventional carrier.

As best illustrated in FIG. 1, a pleated drapery system in accord with the invention includes a conventional traverse rod 10 having a conventional guide track 12 defined in the rear of the traverse rod by ends of inwardly extending rear portions of the traverse rod. Of course, the traverse rod is supported upon conventional brackets, not shown, usually extending in a horizontal direction above the window or opening to be draped.

Figure 3:
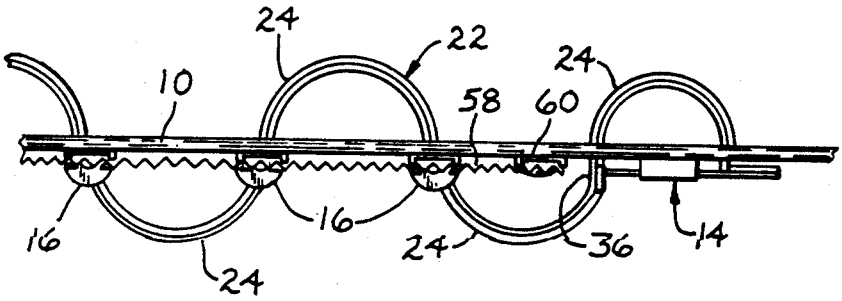
FIG. 3 is a top plan view of a portion of FIG. 2, the drapery being shown.
Figure 6:
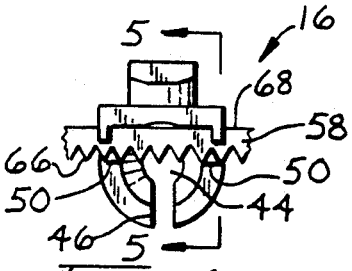
FIG. 6 is a top view of FIG. 5.

A master slide 14 is slidably supported within the traverse rod guide track 12, and is positioned therein by conventional traverse cords, not shown. The traverse rod 10 also slidably supports a plurality of carriers 16, and each carrier is associated with a hanger or pendant 18 having a lower end connected to the header tape 20 which is attached to the drapery 22 adjacent to the draper upper edge and at the drapery inner side. The drapery 22 includes a plurality of "S" pleats 24, FIG. 3, the pleats being of a sinuous configuration, and upon the drapery 22 being fully extended the pleats 24 will be evenly spaced throughout the drapery, the spacing between adjacent pleats being the maximum dimension, while when the drapery is retracted or opened adjacent pleats 24 will engage each other.

The master slide 14 includes a vertically disposed support 26 having a headed anchor 27 which extends through the guide track 12 in the known manner. The support 26 is connected to a horizontally extending hook portion 28 which includes an upwardly extending hook lip 30 for cooperation with the end of the drapery header tape, as later described.

At its left or inner end, FIG. 1, the master slide hook portion 28 has a hook clip 32 mounted thereon. The hook clip 32 includes an upwardly extending hook lip 34 which cooperates with the header tape, as later described, and as will be appreciated from FIG. 1 the length of the hook clip 32 is perpendicular to the length of the master guide hook portion 28 whereby the drapery 22 will be perpendicularly related to the length of the hook portion 28 at the connection point 36 as will be apparent from FIG. 3. As described later, the hook portion 28 and the hook clip 32 orient the drapery 22 to the master slide and hold the drapery in such a manner as to cooperate with another master slide, not shown, in a two way drapery support system, for instance. The master slide 14, and its associated components, firmly supports the end of the drapery 22.

The carriers 16 are identical, and each includes a carrier body 38 preferably formed of a synthetic plastic material such as nylon or the like. The body 38 includes a track head 40, FIG. 5, which extends through the guide track 12 whereby the carriers 16 will easily slide within the track 12 and be supported upon the traverse rod 10. The width of the track head 40 is slightly less than the vertical dimension of track 12, while the vertical height of the head is greater than the track height, permitting installation by a 90° rotation.

Figure 4:
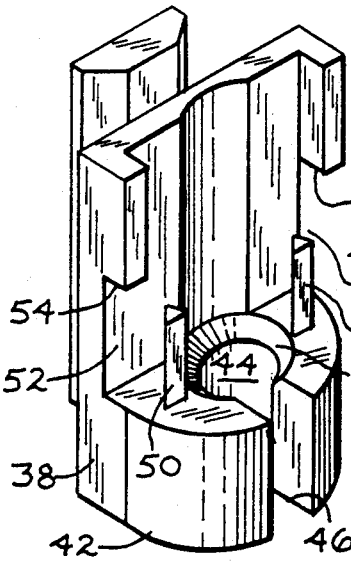
FIG. 4 is an enlarged perspective view of a traverse rod carrier utilizing the inventive concepts.
Figure 5:
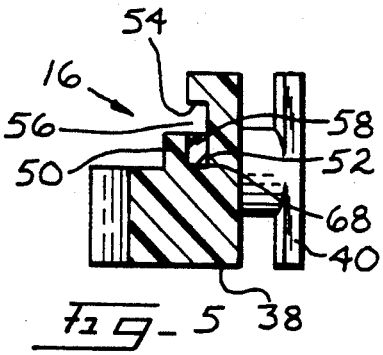
FIG. 5 is an elevational sectional view taken along Section 5—5 of FIG. 6 through the carrier with a tension connector in place.

The carrier body 38 includes a lower enlarged head 42 having a vertically extending hole or passage 44 defined therein. A radial slot 46 defined in the head 40 intersects the hole 44, and the upper end of the hole 44 is formed with a spherical recess 48 for cooperation with the spherical hanger head as later described. A pair of triangular detents 50 are defined on the carrier head 42 extending upwardly, as will be appreciated from FIG. 4. The detents 50 are in an opposed and spaced relationship to a recess 52 defined in the carrier body 38, and the recess 52 is defined at its upper region by overhanging shoulders 54 defined o the carrier body. An access opening 56, FIG. 5, provides access to the recess 52 between the shoulders 54 and the upper ends of the detents 50, and the tension connector is inserted into the recess 52 through the access opening 56 as later explained.

The carriers 16 are interconnected by a tension connector 58. The connector 58 is preferably formed of a flexible strip of synthetic plastic, and at its end is connected to a master slide connector anchor 60, FIG. 1. A pair of connector anchors 60 are formed on the master slide 14, and usually only a single connector anchor is employed with a connector 58, a pair of connector anchors being used to permit the master slide to accommodate installation for either direction of movement on the traverse rod.

The connector anchors 60 each include a detent 62, and a recess 64 similar in configuration to identically named components of the carriers 16.

A plurality of abutments are uniformly defined upon one side of the connector 58, and these abutments take the form of a plurality of V-shaped teeth 66. The sides of the teeth 66 are transversely disposed to the length of the connector and define abutment surfaces which cooperate with the detents 50 and 62 as later described. The connector 58 includes a flat rear surface 68 adapted to engage the recesses 52 and 64, as later explained.

The hangers or pendants 18 are of an elongated configuration and each includes an elongated stem 70. The upper end of the stem 70 includes a head 72 having a downwardly disposed spherical surface complementary in configuration to the carrier spherical recess 48, the head 72 being received within the recess 48 when the hanger is placed within a carrier. The lower end of the hangers 18 includes a hook portion 74 having an upwardly extending hook lip 76. A detent projection 78 is defined on the inside of the hook lip 76, and a hanger latch 80 is formed on the hanger stem 70 in vertically spaced relationship to the hook lip 76, as will be appreciated from FIGS. 9 and 10.

Figure 7:
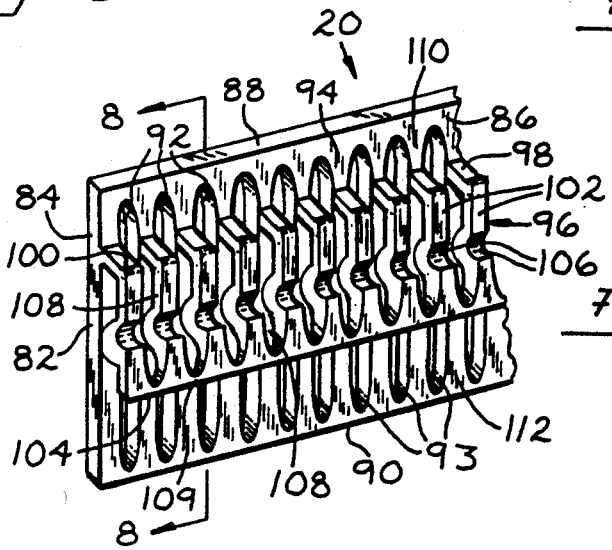
FIG. 7 is a perspective view of the outer side of a header tape in accord with the invention.

The header tape 20 is also preferably formed of a synthetic plastic material, but could be constructed of other materials. As best appreciated from FIGS. 7, 8 and 9, the header tape includes an elongated body 82 having an inner side 84, an outer side 86, and parallel spaced upper and lower edges 88 and 90, respectively. A plurality of parallel upper slots 92 are defined in the body 82 intersecting the sides 84 and 86, and parallel spaced strips 94 are defined between the slots 92. A plurality of lower slots 93 are defined in body 82 in alignment with slots 92 and separated therefrom by body portion 95. The slots 92 and 93 terminate short of the edges 88 and 90 by about .050 inches permitting the tape to have a continuous length, but the length of the slots 92 and 93, and their dimension, is such that the tape body 82 will be readily flexible in the lateral direction of the sides 84 and 86 even though the body 82 is formed of a semi-rigid synthetic plastic material. However, as the strips 94 extend in a vertical direction the body 82 is relatively stiff in the vertical direction and is capable of supporting the vertical weight of the drapery, as later described.

Figure 8:
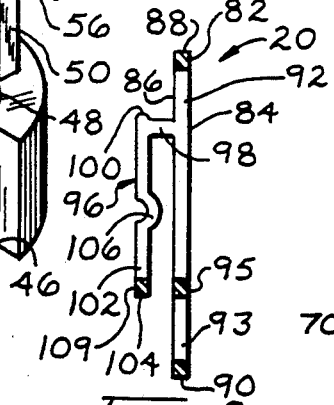
FIG. 8 is an elevational sectional view taken through the header tape along Section 8—8 of FIG. 7.

A drapery supporting lip 96 homogeneously formed on the outer side 86 of the body 82 includes a base portion 98 substantially perpendicularly related to the plane of the body 82 as will be appreciated from FIG. 8. The base portion 98 defines a shoulder 100 which may include an upwardly extending bulbous configuration, and the lip includes a flange portion 102 downwardly extending from the base portion 98. The flange portion 102 terminates in a free or cantilevered end edge 104. An inwardly extending radiused rib 106 is formed in the lip flange extending toward the body outer side 86 for friction and detent retention purposes with the hanger as later explained. A plurality of vertically extending slots 108 are defined in the flange portion 102 and in the base portion 98. The slots 108 are in alignment with the header tape body slots 92 and are of the same width. Preferably, the slots 108 do not intersect the flange portion free end 104, but terminate shortly therefrom, to form portion 109 which is in alignment with body portion 95. As the slots 92, 93 and 108 are punched from the body 82 the portions 95 and 109 are formed during punching. As will be appreciated from FIG. 7, the above described lip construction causes the lip base portions 98 to extend from the body strips 94, and the slots 108 permit the desired lateral flexibility of the body 82 in the direction of the sides 84 and 86. However, the flange portions intermediate the slots 108 stiffen the lip 98 in the vertical direction providing the lip with sufficient strength to support the drapery through the associated hangers 18.

The header tape 20 is attached to the inside of the drapery 22 adjacent the upper edge of the drapery. Preferably, the header tape is sewn to the drapery by machine sewing, the body slots 92 permitting the upper sew portion 110 of the header tape to be sewn to the drapery, and as the lip free end 104 terminates short of the tape body lower edge 90 a lower sew portion 112 is defined on the header tape to permit the lower portion of the header tape to be sewn to the drapery through slots 93.

When installing the drapery system of the invention the installer determines how many pleats 24 are desired in a particular installation. Because of the nature of the "S" pleats 24 it is possible to accommodate a wide variety of drapery material widths within a given window or opening dimension merely by determining the extent of projection of the pleats in front of and behind the vertical plane containing the traverse rod 10. The greater the forward and rear extension of the pleats from the traverse rod 10, the greater the length of material which may be accommodated within a given drapery extension dimension, and if the width of drapery material is only slightly greater than the extended width of the drapery, the extension of the pleats 24 from the vertical plane of the traverse rod will be minimal.

By use of a guide and strip pattern somewhat similar to that shown in my U.S. Pat. No. 3,664,026 the spacing between adjacent carriers 16 can be readily determined for a given width of drapery material and the extended length of the drapery desired. Thereupon, upon determining the spacing between drapery pleats desired the appropriate number of carriers 16 may be located within the traverse rod guide track 12, and the end of the flexible tension connector 58 will be attached to a connector anchor 60 as shown in FIG. 1. By placing the end of the connector 58 within the anchor recess 64 the detent 62 will engage the connector teeth 66 and in this manner the end of the connector 58 is attached to the master slide 14.

By means of measurement, or pattern, the spacing between carriers 16 is determined, and maintained, by straightening the tension connector 58 between adjacent carriers and inserting the connector into the carrier recesses 52 through the access opening 56. In placing the connector within the recess 52 through the access opening 56 the connector will be "rolled" over the top of the detents 50 upon the detents 50 being aligned with connector teeth 60 and the dimensions of the carrier recess 52, and connector, are such that the connector rear surface 68 will engage the recess surface opposite to the detents 50 maintaining the detents in firm engagement with connector teeth 66, and this relationship "locks" the carriers 16 relative to the connector 58 preventing relative movement between the connector and associated carrier. The vertical dimension of the connector 58 is such that merely vertical movement of the connector within the recess 52 will not permit the connector to escape the recess as the overhanging shoulders 54 will be engaged. It is necessary to twist and roll out the connector from behind the detents 50 to disengage the connector and carriers. Similar relationships to those described above exist between the connector 58 and the master slide anchors 60.

Figure 9:
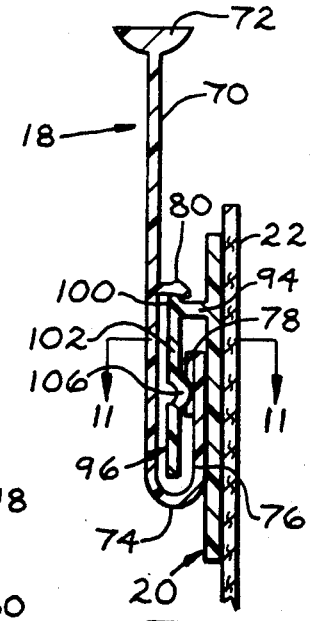
FIG. 9 is an elevational sectional view taken through the header tape and hanger pendant along Section 9—9 of FIG. 1 wherein the hanger is fully interrelated with the tape lip, the carrier not being shown.
Figure 12:
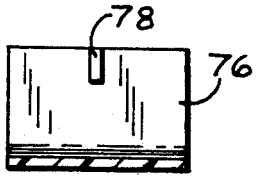
FIG. 12 is an elevational sectional view taken through the hanger hook portion along Section 12—12 of FIG. 10.
Figure 11:
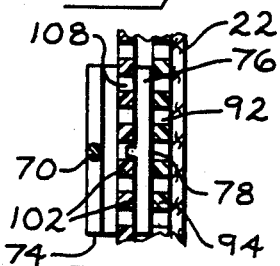
FIG. 11 is a plan sectional view taken along Section 11—11 of FIG. 9.
Figure 10:
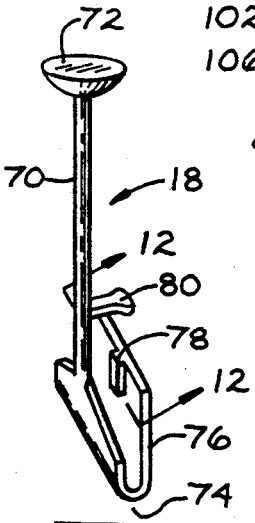
FIG. 10 is a perspective view of a hanger pendant in accord with the invention.
Figure 2:
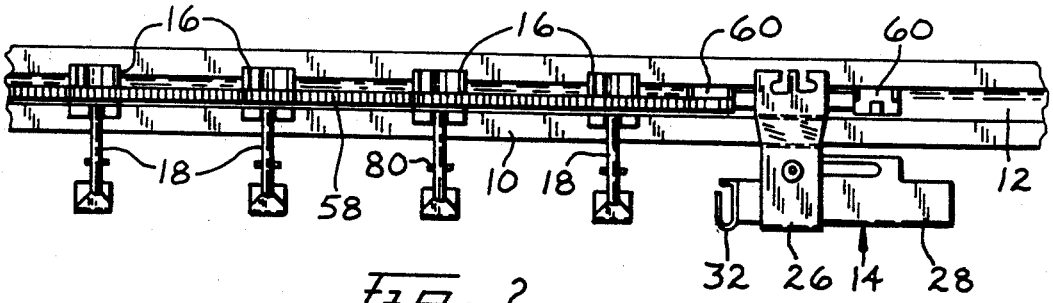
FIG. 2 is an elevational rear view of a drapery traverse rod installation using the inventive concepts illustrating four carriers and a master slide, the drapery and header tape not being illustrated.

After the spacing between the carriers 16 has been achieved by interconnecting the carriers with the connector 58, the hangers 18 can now be connected to the header tape 20, which has previously been sewn to the drapery 22, as described above. Upon determining the location that a hanger 18 is to be attached to the header tape 20, by measurement or pattern, the hanger hook lip 76 is slipped under the header tape lip end 104 and the hanger is moved upwardly with respect to the header tape to locate the hook lip 76 between the lip flange portion 102 and the tape body outer side 86 as shown in FIG. 9. During this operation the hanger stem 70 has sufficient flexibility to bend the stem away from the lip flange portion 102 to provide clearance of the latch 80 from the lip 96, and the lip flange portion rib 106 will frictionally engage the hanger lip 76 holding the same against the outer side 86 of the tape body. Upon sufficient insertion of the lip 76 under the lip flange portion 102 the hanger latch 80 will overlie the lip shoulder 100, and the latch is of a width greater than that of the lip slots 108 as to overlap at least a portion of two of the vertical lip strips which form the flange portion 102. The overlying of the latch 80 over the shoulder 100 prevents the hanger 18 from disassociating from the header tape 20 and the detent projection 78 defined on the hook portion 76 will be received within a lip slot 108 at ribs 106 as apparent in FIGS. 9 and 11 preventing relative longitudinal movement between the hangers and header tape.

Upon the hangers 18 being connected to the header tape as desired the drapery 22 can now be hung from the traverse rod. Such hanging is produced by inserting the hanger stems 70 through the appropriate carrier slots 46 so that the hanger heads 72 may rest within the carrier recesses 48. Of course, when the weight of the drapery is placed upon the hangers 18 the header tape free end 104 will engage the lowermost portion of the hanger hook 74 whereby the weight of the drapery 22 will be transferred to the hangers 18.

The drapery is attached to the master slide 14 by inserting the lip 96 into the hook lip 34 of the clip 32, and likewise, hooking the lip 30 of the hook portion 28 under the lip 96 to maintain the end of the drapery parallel to the traverse rod 10. Accordingly, the header tape will properly position the drapery end to the master slide 14, and as the clip 32 is perpendicularly disposed to the traverse rod the clip will aid in maintaining the pleat configuration.

The drapery 22 is now fully hung from the traverse rod 10 by the carriers 16 and the master slide 14. When the master slide 14 is moved in the direction of the carriers 16 the connector 58 will flex away from the traverse rod 10 and permit adjacent pleats 24 to engage each other and contract the drapery width to the point where all of the pleats 24 will be fully contracted. When the master slide 14 is moved in the opposite direction to extend the drapery width the initial movement of the master slide 14 will tension that portion of the connector 58 between the master slide and the closest carrier 16 and the tension within the connector 58 will then cause such carrier 16 to move with the master slide. Likewise, as subsequent portions of the connector 58 are tensioned as the master slide moves in the direction to extend the drapery the connector 58 will sequentially "pull" the carriers to the right, FIG. 1, and cause the drapery 22 to be extended. Upon the drapery being fully extended all of the portions of the tension connector 58 will be in a straight or tensioned condition, and no tension will have been applied to the drapery material during opening of the drapery. As explained above, the dimensions of the pleats 24 with respect to their degree of extension from the vertical plane of the traverse rod will depend upon the initial length of the drapery material and the spacing determined between carriers 16 as controlled by the tension connector 58.

As the connector 58 may be readily removed from, and installed to, the carriers 16 the addition of carriers to change the pleat form, or to permit other drapery material to be employed of a different material width than that previously used, may be readily accomplished with minimal skills. By forming many of the components of synthetic plastic, economical manufacturing techniques may be used, and significant economies are experienced in the use of the invention due to the ability to employ standard drapery widths and seamless material to accommodate a wide variety of drapery extended dimensions.

It is appreciated that various modifications to the inventive concepts may be apparent to those skilled in the art without departing from the spirit and scope of the invention.

I claim:

1. In a drapery hanging system for "S" pleated drapery, in combination, an elongated traverse rod, a track defined on said rod, a plurality of drapery carriers slidably guided within said track, an elongated flexible tension connector interconnecting adjacent carriers, spaced abutments defined on said connector along the length thereof and abutment engaging detents defined upon said carriers adapted to releasably engage selected abutments to permit adjustable spacing between adjacent carriers upon tensioning of said connector.

2. In a drapery hanging system as in claim 1, a single flexible connector extending between a plurality of said carriers.

3. In a drapery hanging system as in claim 2, said connector being formed of a synthetic plastic material.

4. In a drapery hanging system as in claim 2, said abutments comprising teeth defined on said connector, said teeth including surfaces transversely disposed to the length of said connector.

5. In a drapery hanging system as in claim 4, said teeth being uniformly spaced along the length of said connector.

6. In a drapery hanging system as in claim 4, said abutment engaging detents comprising at least one detent defined on a carrier, said detent including a projection having a configuration complementary to the configuration of said teeth and adapted to engage said teeth, and a connector receiving recess defined in said carriers adjacent said detent selectively receiving said connector to retain said connector while engaged by said detent.

7. In a drapery hanging system as in claim 6, an access opening defined in said carriers, recess, said connector being insertable into said recess through said access opening.

8. In a drapery hanging system for "S" pleated drapery having an upper edge adapted to be hung from an elongated traverse rod having a track and carriers slidably mounted within the track comprising, in combination, an elongated header tape having inner and outer sides, a top and a bottom, said tape being laterally flexible in the direction of said sides and semi-rigid in the direction between said top and bottom, means defined on said tape for attaching said tape to the drapery adjacent the upper edge thereof with said inner side disposed toward the drapery, a tape support lip defined on said tape outer side, said lip including an upper end attached to said tape outer side and a free lower end extending toward said tape bottom, a plurality of elongated hangers each having an upper end and a lower end, a carrier mounting head defined on said hanger's upper end for attaching and suspending the hanger from a track mounted carrier, and a hook portion defined on said hanger's lower end for receiving said tape support lip free end whereby said tape and attached drapery are suspended from the carriers by said hangers.

9. In a drapery hanging system as in claim 8, a latch defined on said hanger adjacent said hook portion for releasably latching said hook portion to said tape support lip.

10. In a drapery hanging system as in claim 8, interengaging detent means defined on said hanger and said tape support lip preventing relative displacement of said hanger and said lip in the direction of the length of said tape.

11. In a drapery hanging system as in claim 8, said tape support lip including a plurality of substantially parallel vertically extending slots extending from said lip upper end to adjacent said lip free end, said slots providing lip lateral flexibility.

12. In a drapery hanging system as in claim 11, a detent projection defined on said hanger hook portion, said detent projection adapted to be received within a lip slot to prevent relative displacement of said hanger and associated lip in the direction of the length of said tape.

13. In a drapery hanging system as in claim 12, said tape support lip upper end including a shoulder a latch defined on said hanger, said latch engaging and overlaying said shoulder upon said lip free end being fully received within said hanger hook portion to latch said hanger to said lip.

14. In a drapery hanging system as in claim 8, said header tape being formed of a synthetic plastic material.

15. An elongated header tape for drapery comprising, in combination, a body having inner and outer sides, a top edge and a bottom edge, a plurality of substantially parallel first slots defined in said body extending between said top and bottom edges terminating short of said edges, said slots permitting said body to laterally flex in the direction of said sides, a lip defined on said body outer side, said lip having an upper end affixed to said outer side and a free lower end extending toward said bottom edge, second slots defined in said lip in alignment with said first slots, said second slots intersecting said lip upper end and extending toward said lip lower free end, said body being formed of a semi-stiff material whereby said lip is capable of supporting sufficient vertical forces imposed thereon to support the weight of drapery material attached to said header tape body.

16. In a header tape as in claim 15, said body being formed of a synthetic plastic material.

17. In a header tape as in claim 15, said second slots terminating short of said lip lower free end.

18. In a header tape as in claim 15, said lip upper end including a base portion substantially perpendicular to said body at the point of attachment thereto and a flange portion depending from said base portion toward said lower edge spaced from and substantially parallel to said body outer side, said second slots being defined in said base and flange portions.

* * * * *